US006553692B1

(12) United States Patent
Chung

(10) Patent No.: US 6,553,692 B1
(45) Date of Patent: Apr. 29, 2003

(54) SHOCK ABSORPTION MECHANISM FOR SHOES

(75) Inventor: Min Woo Chung, JinJoo (KR)

(73) Assignee: Gary G. Pipenger, Fort Wayne, IN (US)

( * ) Notice: Subject to any disclaimer, the term of this patent is extended or adjusted under 35 U.S.C. 154(b) by 0 days.

(21) Appl. No.: 09/111,947

(22) Filed: Jul. 8, 1998

(Under 37 CFR 1.47)

(51) Int. Cl.[7] ..... A43B 21/32; A43B 13/28
(52) U.S. Cl. ..... 36/37; 36/27; 36/35 R
(58) Field of Search ..... 36/28, 27, 37, 36/38, 35 R

(56) References Cited

U.S. PATENT DOCUMENTS

| | | | | | |
|---|---|---|---|---|---|
| 4,894,934 | A | * | 1/1990 | Illustrato | 36/37 |
| 5,282,325 | A | * | 2/1994 | Beyl | 36/27 |
| 5,701,685 | A | * | 12/1997 | Pezza | 36/27 |
| 5,832,629 | A | * | 11/1998 | Wen | 36/27 |
| 6,055,747 | A | * | 5/2000 | Lombardino | 36/37 |
| 6,115,943 | A | * | 9/2000 | Gyr | 36/35 R |

FOREIGN PATENT DOCUMENTS

| | | |
|---|---|---|
| KR | 9017916 | 6/1992 |
| KR | 9105925 | 11/1992 |
| KR | 9201238 | 8/1993 |
| KR | 9201239 | 8/1993 |
| KR | 9527642 | 3/1997 |

* cited by examiner

*Primary Examiner*—M. D. Patterson
(74) *Attorney, Agent, or Firm*—Krieg DeVault Lundy, LLP

(57) ABSTRACT

A new and improved shock absorption mechanism for shoes comprising a plurality of members defining an upper support planar surface and a lower support planar surface. The upper planar surface and lower planar surface are moveable toward and away from each other. A plurality of near-collapsible members are operatively connected between the upper and lower planar surfaces. The collapsible members are moveable between an extended position and a collapsed position. Each of the collapsible members has a spring associated therewith for urging the members into their extended position. The plurality of members and the collapsible members are connected and positioned within a collapsible heel of a shoe. The springs have a spring constant sufficient to support the weight of the wearer of the shoe and to absorb the shock when a forceful impact is exerted on the members which urge the members together against the urging of the springs, whereby both the acceleration and the velocity of said members is gradually reduced to zero.

21 Claims, 10 Drawing Sheets

SHOCK ABSORPTION MECHANISM FOR SHOES

BACKGROUND OF THE INVENTION

This invention relates to a shock absorption mechanism for shoes, and more particularly to a shock absorption mechanism positioned within the heel of a shoe to absorb shock upon impact and to maintain good shoe stability.

The terms "shock absorption," or "absorption of shock," or other like terms all relate to the ability of a device compressing or expanding upon a force being applied to the device, to reduce that force to zero, to reduce the acceleration of the device to zero, and to reduce the velocity of that device to zero in a manner in which rapid changes of acceleration or velocity are not experienced. In order to provide comfort when wearing the shoe, this "shock absorption" must be accomplished whereby the decrease in acceleration is gradual and the decrease in velocity is gradual. For example, if the acceleration is reduced to zero and the velocity is reduced to zero instantaneously, as the words "shock absorption" are used herein, no shock absorption has occurred. The term "shock absorption" has nothing to do with inner soles which may be utilized in addition to the shock absorption device to Make a shoe comfortable in a static condition.

The term "shoe stability" is used herein to describe a feature of a shoe which will, in a static condition and upon walking, support the weight of the person wearing the shoe in a manner which allows the person to have good balance. A shoe with "good stability" provides the person with support that is firm and dimensionally stable, and does not provide the person with a feel that he is walking on wet sand or "SILLY PUTTY."

In the past, cushioned innersoles have been provided for shoes which are formed of compressible, elastomeric material, such as cellular or plastic foam, foam rubber, or the like. These innersoles have provided only a limited amount of shock absorbency, or none at all resulting in little or no significant improvement in the wearer's comfort. It is therefore highly desirable to provide a new and improved shock absorption mechanism for shoes.

Recently, shoes have been provided with soles having air cushions in the toe and heel or throughout the sole with air circulation between separated air cushions. The air cushions have been provided with mechanisms that circulate the air and ventilate the shoes during walking activities. These air cushions, however, have been known to wear and to vary the shock absorption and the circulation of air during use, and the shock absorption provided is directly proportional to the compressibility of air and the circulation of air during use. Thus, it is highly desirable to provide a new and improved shock absorption mechanism for shoes which maintains its shock absorption properties during use.

In some shoes, an air pump is incorporated in the heel of the shoe which is more or less in communication with one or more air bladders located in the toe or other portions of the shoe. An example of these shoes are disclosed in U.S. Pat. No. 4,995,173 and this inventor's Korean Patent No. 60907, Korean Patent Published Nos. 94-7402 (Application No. 91-20772), 94-1007 (Application No. 92-1238), and 94-10008 (Application No. 92-1239).

These shoes, in the past, have experienced difficulties in that the air bladders leak, and the communication between air bladders change during use, and the shock absorption feature of the shoe either cannot be relied upon or is too much dependent upon the compressibility of air, and thus, does not absorb the shock satisfactorily. Thus, it is highly desirable to provide a new and improved shock absorption mechanism for shoes which does not involve an air cushion. It is also highly desirable to provide a new and improved shock absorption mechanism for shoes which does not have one or more air bladders in communication with each other. It is also highly desirable to provide a new and improved shock absorption device for a shoe which does not have all of the disadvantages of air cushions and bladders. It is also highly desirable to provide a new and improved shock absorption mechanism which has a mechanical shock absorption mechanism.

Finally, there have been provided shoes with a spring device positioned in the heel. Examples of such devices are disclosed in U.S. Pat. No. 4,843,737. However, such devices have not been dimensionally stable and thus, become "stuck" against other portions of the shoe and cannot be relied upon to function properly, do not provide the good shoe stability required, are highly complex, have multiple parts and are relatively expensive to manufacture and assemble, or do not have the necessary shock absorption property desired, or at times do not provide the appropriate stability required in a shoe.

Therefore, it is highly desirable to provide a new and improved shock absorption mechanism for shoes to be positioned in the heel portion of the shoe. It is also highly desirable to provide a new and improved shock absorption mechanism for shoes which is dimensionally stable during compression. It is also highly desirable to provide a new and improved shock absorption mechanism for a shoe which is comprised of few parts, is relatively inexpensive to manufacture and is relatively simple to assemble. It is also highly desirable to provide a new and improved shock absorption mechanism for a shoe which provides appropriate stability and support for the shoe when not under impact.

Both good shoe stability and good shock absorption properties require that any shock absorption mechanism used in children's, women's and men's shoes be adjustable to provide these properties for persons of various weight.

Finally, it is highly desirable to provide a new and improved shock absorption mechanism for a shoe which has all of the above features.

SUMMARY OF THE INVENTION

It is therefore an object of the invention to provide a new and improved shock absorption mechanism for shoes.

It is also an object of the invention to provide a new and improved shock absorption mechanism for shoes which maintains its shock absorption properties during use.

It is also an object of the invention to provide a new and improved shock absorption mechanism for shoes which does not involve an air cushion.

It is also an object of the invention to provide a new and improved shock absorption mechanism for shoes which does not have one or more air bladders in communication with each other.

It is also an object of the invention to provide a new and improved shock absorption mechanism for shoes which has a mechanical shock absorption device.

It is also an object of the invention to provide a new and improved shock absorption mechanism for shoes which does not have all of the disadvantages of air cushions and bladders.

It is also an object of the invention to provide a new and improved shock absorption mechanism for shoes to be positioned in the heel portion of the shoe.

It is also an object of the invention to provide a new and improved shock absorption mechanism for shoes which is dimensionally stable during compression.

It is also an object of the invention to provide a new and improved shock absorption mechanism for shoes which is comprised of few parts, is relatively inexpensive to manufacture and is relatively simple to assemble.

It is also an object of the invention to provide a new and improved shock absorption mechanism for a shoe which provides appropriate stability and support for the shoe when not under impact.

Finally, it is an object of the invention to provide a new and improved shock absorption mechanism for shoes which has all of the above features.

In the broader aspects of this invention, there is provided a new and improved shock absorption mechanism for shoes comprising a plurality of members defining an upper support planar surface and a lower support planar surface. The upper planar surface and lower planar surface are moveable toward and away from each other. A plurality of near-collapsible members are operatively connected between the upper and lower planar surfaces. The collapsible members are moveable between an extended position and a collapsed position. Each of the collapsible members has a spring associated therewith for urging the members into their extended position. The plurality of members and the collapsible members are connected and positioned within a collapsible heel of a shoe. The springs have a spring constant sufficient to support the weight of the wearer of the shoe and to absorb the shock when a forceful impact is exerted on the members which urge the members together against the urging of the springs, -whereby both the acceleration and the velocity of said members is gradually reduced to zero.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
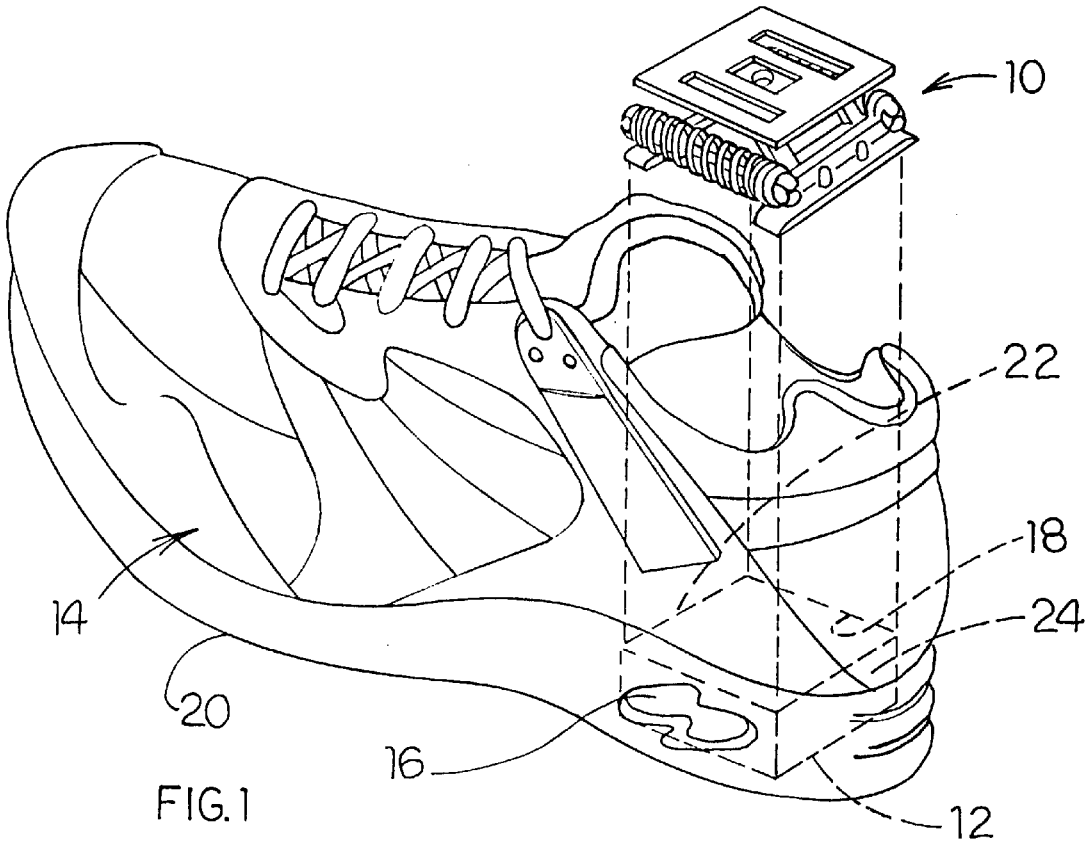
FIG. 1 is an exploded perspective view of a shoe showing the new and improved shock absorption mechanism of the invention installed in the heel of a shoe.
Figure 2:
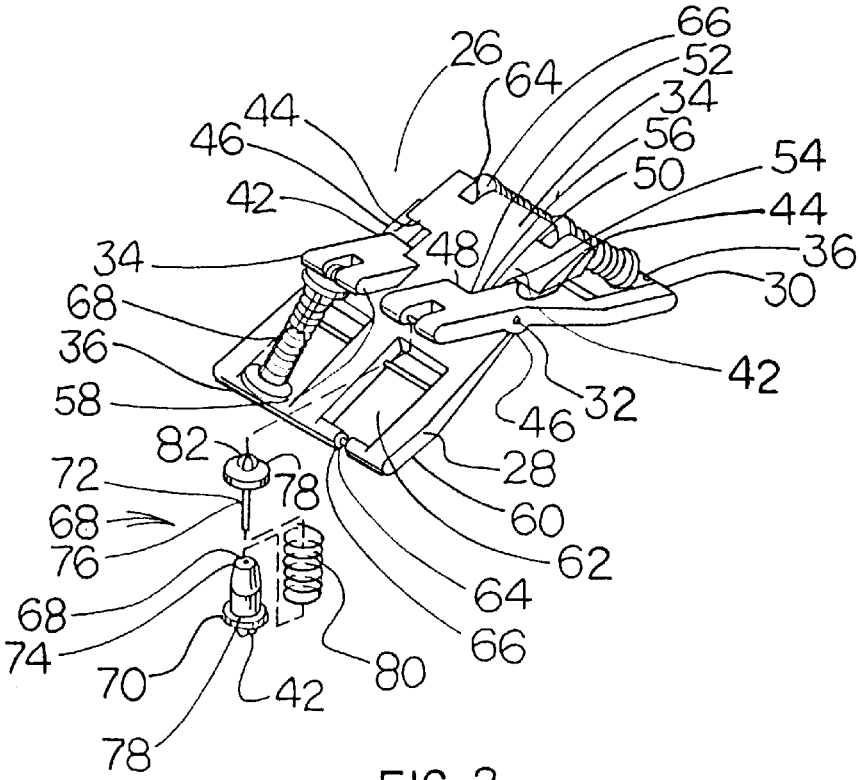
FIG. 2 is an exploded perspective view of one mode of the new and improved shock absorption mechanism of the invention.

Referring now to the drawings, and more specifically to FIG. 1, there is shown one mode of the new and improved shock absorption mechanism 10 of the invention. The shock absorption mechanism of the invention is positioned in the heel 12 of a shoe 14 as shown in FIG. 1. Heel 12 has a window 16 therein, through which the system 10 can be viewed. The heel 12 has a cavity 18 therein defined by an outer sole 20 and an inner sole 22 and peripheral walls 24. Peripheral walls 24 are collapsible such that the shock absorption mechanism 10 of the invention is that which keeps the heel 12 and the walls 24 expanded and the shoe provides the wearer the full support accustomed in wearing shoes. In all modes, cavity 18 has dimensions larger than the exterior dimensions of the shock absorption mechanism 10 of the invention fully collapsed.

First mode 26 of the shock absorption mechanism 10 of the invention is shown in FIGS. 2–5. Mode 26 comprises a left plate member 28 and a right plate member 30 linked together by a pivot pin 32 as shown. Left plate member 28 has opposite top 34 and bottom 36 ends. Between ends 34 and 36 is positioned a pair of slots 38, 40 defined by spaced apart slot bottoms 42 and spaced apart slot sides 44 which define oppositely facing slot openings 46. Spaced apart slot bottoms 42 define a throat portion 48 therebetween.

Right member 30 includes an opening 50 therein between top end 34 and bottom end 36 in which throat portion 48 is positioned. Opening 50 has a top 52, a bottom 54 and opposite sides 56. Top end 34 has a slot 58 extending therethrough from end 34 to opening 50 allowing throat member 48 of left member 28 to be positioned in opening 50 of right member 30 to define an "X" shaped linkage 60. Adjacent bottom end 36 of both right member 30 and left member 28 is positioned a plurality of spaced link openings 62. Openings 62 communicate with bottom ends 36 by means of link slots 64 which are spanned by link pins 66. Similarly, top ends 34 of both left member 28 and right member 30 have positioned therein a plurality of spaced link slots 64 which are similarly spanned by link pins 66.

Positioned on link pins 66 and between top ends 34 and bottom ends 36 of left member 28 and right member 30 is a plurality of link rods 68. Each link rod 68 has a keeper member 70 and a trailing member 72. Keeper member 70 has a cylindrical passageway 74 therein. Trailing member 72 has a guide rod 76 extending into passageway 74. Both keeper member 70 and trailing member 72 have end flanges 78 thereon each link rod 68 comprises a trailing member 72 assembled on a keeper member 70 with its guide rod 76 positioned in passageway 74 with a spring 80 positioned between end flanges 78. Both keeper member 70 and trailing member 72 have a bushing 82 at their opposite distal ends in which link pins 66 are positioned so as to extend link rods 68 between the opposite top ends 34 and bottom ends 36 of left member 28 and right member 30 as shown. Spaced apart top ends 34 define an upper support planar surface 84 and spaced apart lower ends 36 define a lower support planar surface 86. See FIG. 3.

Figure 3:
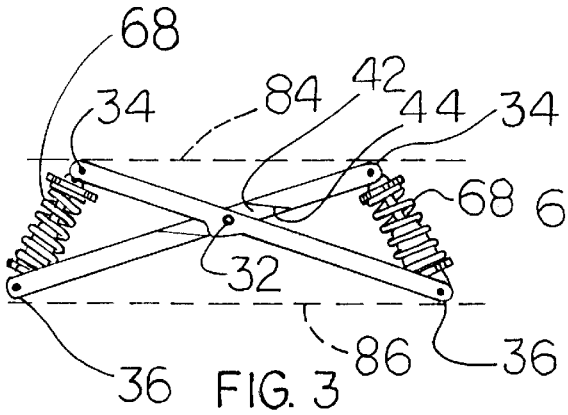
FIG. 3 is a side view of the new and improved shock absorption mechanism of the invention shown in FIG. 2 in a fully expanded condition.
Figure 4:
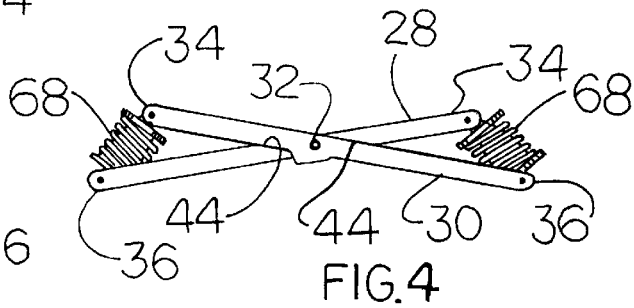
FIG. 4 is a side view of the shock absorption mechanism of the invention shown in FIG. 2, in a partially collapsed state.

In a specific embodiment, both left hand member 28 and right hand member 30 are molded of a suitably strong polymeric material. This material has inherent resiliency and strength so as to function as described herein. As the inner sole 22 is urged toward the outer sole 20, mode 26 of mechanism 10 is compressed from the fully expanded position as shown in FIG. 3 to its partially collapsed position as shown in FIG. 4 to its fully collapsed position shown in FIG. 5. As the mode 26 is collapsed, the upper support planar surface 84 is urged toward the lower support planar surface 86, the top ends 34 and the bottom ends 36 slide outwardly on the inner sole 22 and outer sole 20, respectively, and the springs 80 of the rods 68 are compressed.

Figure 5:
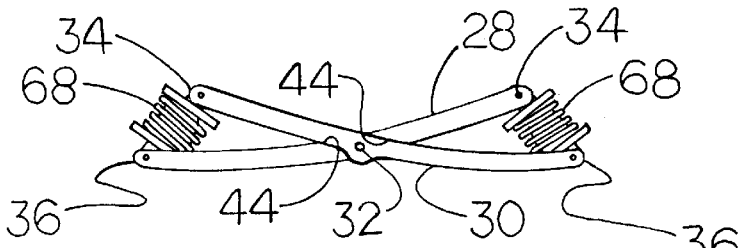
FIG. 5 is a side view of the new and improved shock absorption mechanism of the invention shown in FIG. 2 in a fully collapsed state.
Figure 6:
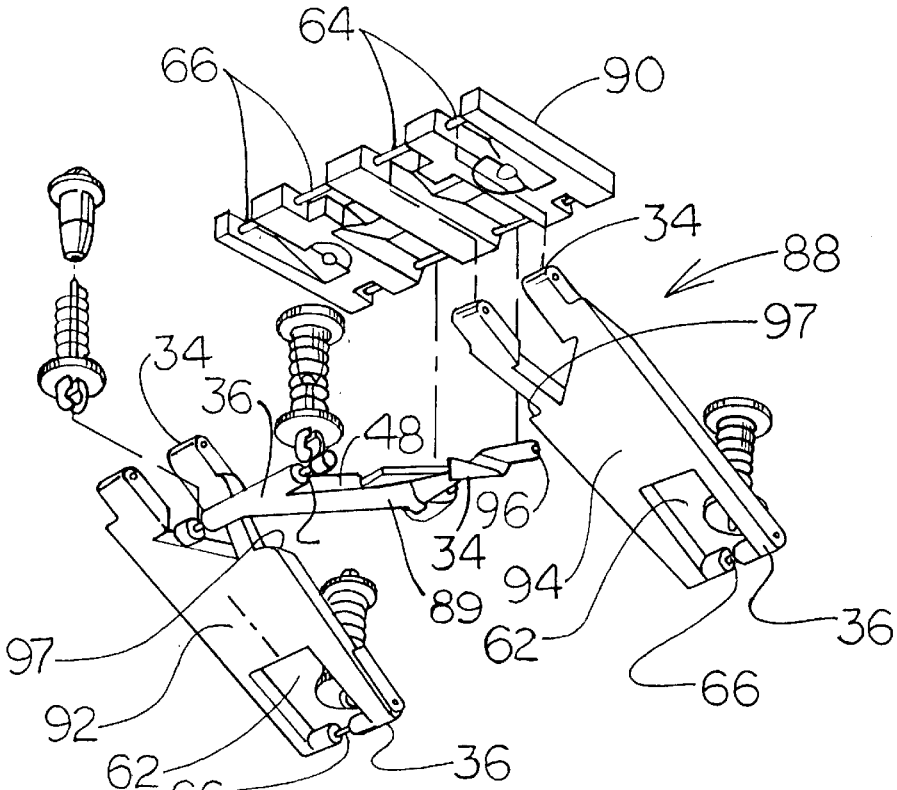
FIGS. 6, 7, 8 and 9 are similar to FIGS. 2, 3, 4 and 5 of a second mode of the invention.

In the partially collapsed position, left member 28 and right member 30 are engaged at opposite sides 56 and slot sides 44 as shown in FIG. 4 such that around pin 32, further motion of left member 28 and right member 30 is not permitted. However, as shown in FIG. 5, further urging of the inner sole 22 toward the outer sole 20 can be accomplished through the flexibility and resiliency of left member 28 and right member 30 and further compression of springs 80 of the link rods 68. When the urging of the outer sole 20 toward the inner sole 22 ceases, springs 80 of the link rods 68 urge the members 28, 30 back into its expanded condition as shown in FIG. 3.

Referring now to FIGS. 6–9, there is shown a second mode 88. Second mode 88 is similar to first mode 26. In all of the different modes described herein, like parts will be given like reference numerals and reliance upon the description of these parts above will be made by incorporating such descriptions herein as if it were repeated in describing the subsequent modes. Generally, second mode 88 comprises a single 89 left member 28 and a pair 92, 94 of right members 30. Members 89, 92 and 94 are connected together by a top member or pedestal 90 which defines upper support planar surface 84. Bottom ends 36 still define lower support planar surface 86. Bottom ends 36 of left member 89 and right members 92, 94 are connected to top member 90 by link rods 68.

Left member 89 has a throat 48 extending between spaced apart bushings 96 in top end 34 and spaced apart pins 66 in end 36. Throat 48 is positioned between right members 92 and 94. Top ends 34 of left member 89 and right members 92 and 94 are pivotally connected to top member 90 by pins 66 in link slots 64. Link rods 68 are connected between pins 66 in link slots 64 adjacent top end 34 and pins 66 in link openings 62 adjacent the bottom ends 36 of right members 90 and 94 and left member 89. Right members 92, 94 each have stops 97 thereon midway between ends 34, 36 which engage left member 89 above throat member 88 when members 89, 92, 94 are partially collapsed.

Figure 7:
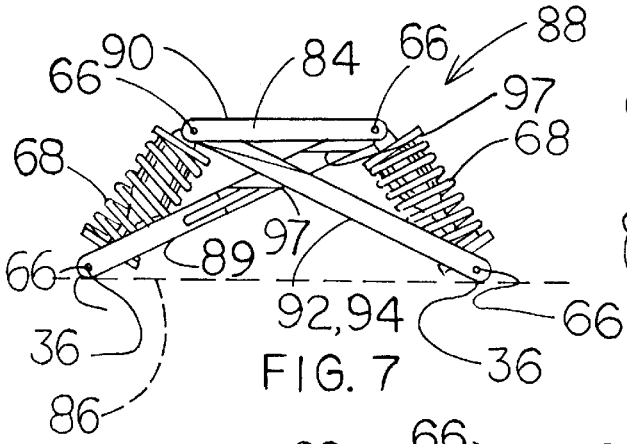
Figure 8:
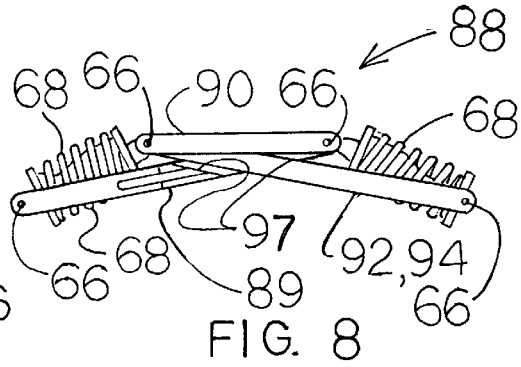
Figure 9:
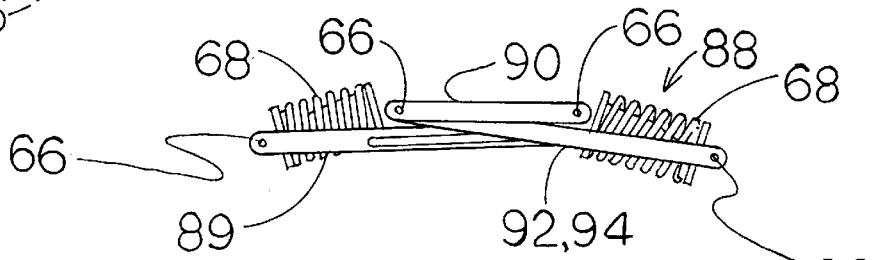

In FIGS. 7, 8, and 9, second mode 88 is shown in a fully expanded condition, a partially collapsed condition, and a fully collapsed condition, respectively. As the outer sole 20 is urged toward the inner sole 22, the top bottom ends 36 of right and left members 89, 90, 92 glide upon the outer sole 20 and top member 90 approaches the outer sole 20. In FIG. 8, the left member 89 and the right members 90, 92 engage each other at stops 97 such that movement therebetween can proceed no further. The additional movement between the partially collapsed position of FIG. 8 and the fully collapsed position of FIG. 9 is accomplished by the flexibility and resiliency of the left member 28 and the right members 92, 94 and further compression of the rods 68 as above-described.

Figure 10:
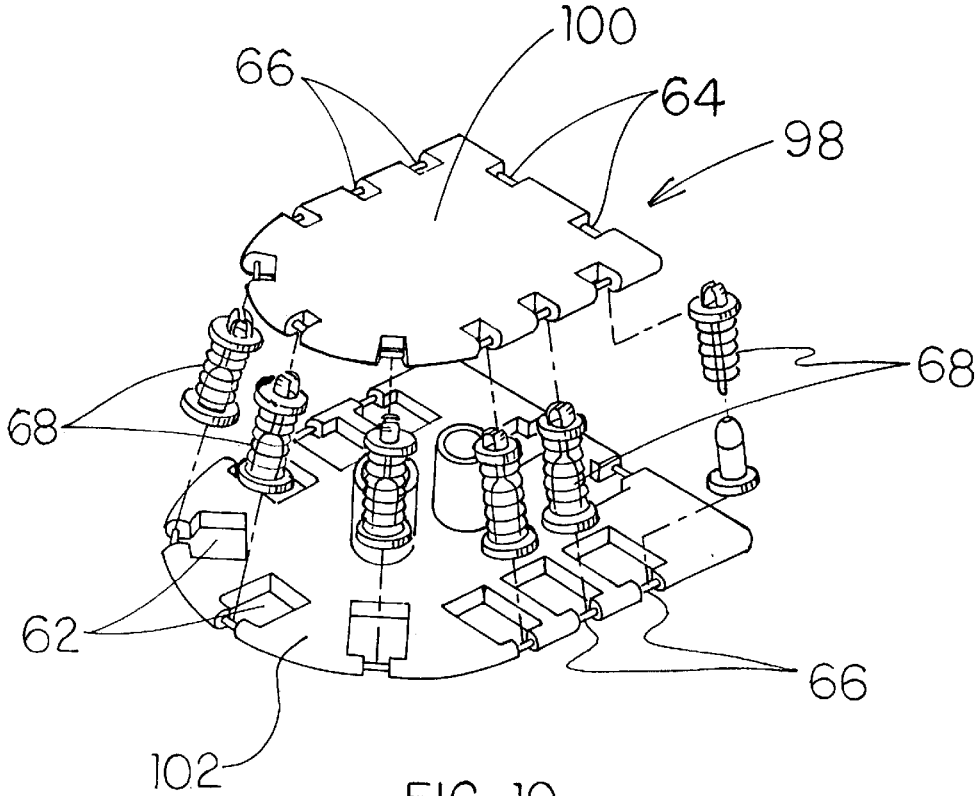
FIGS. 10, 11 and 12 are similar to FIGS. 2, 3 and 5 of a third mode of the invention.
Figure 11:
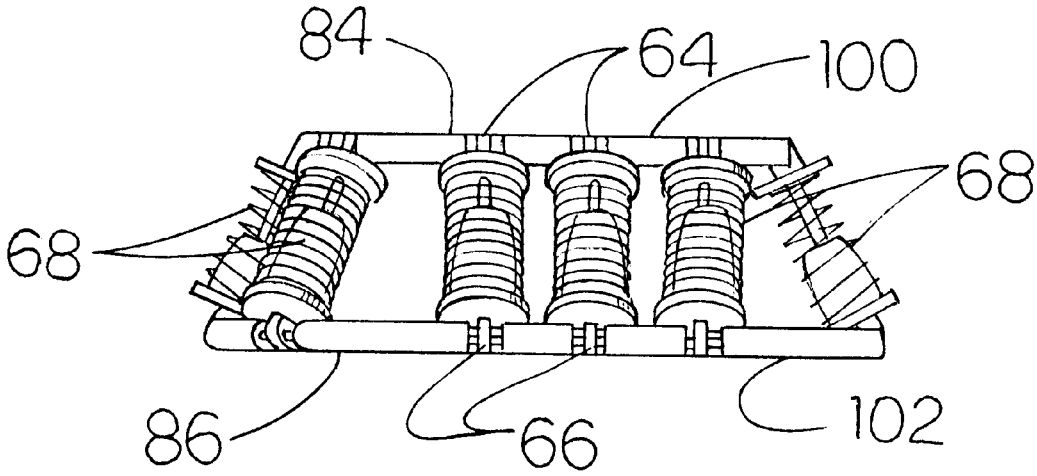
Figure 12:
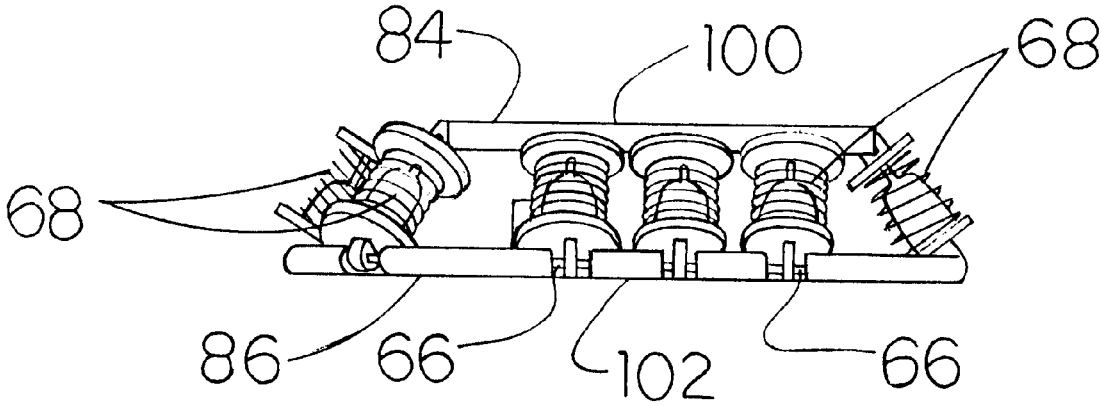

Referring now to FIGS. 10, 11 and 12, there is shown a third mode 98 of the invention which includes an upper member or pedestal 100, a lower member or pedestal 102 between which a plurality of link rods 68 are connected utilizing a plurality of spaced apart links lots 64 link pins 66 therein and the same member of spaced link openings 62 with link pins 66 therein as heretofore described. Link slots 64 and pins 66 are spaced apart along the periphery of the upper member 100. Link openings 62 and pins 66 are spaced apart along the periphery of the lower member 102. Link rods 68 extend between each pair of pins 66 in upper and lower members 100 and 102. In specific embodiments, one or more stop 101 may be positioned between members 100 and 102 to limit the movement of members 100 and 102, and pins 130 may be positioned therein to provide an adjustment to the shock absorbency of mode 98 as will be explained more fully hereinafter with regard to fourth mode 108.

FIG. 11 shows third mode 98 in its fully expanded condition; FIG. 12 shows third mode 98 in its fully collapsed condition. Similar to the first 26 and second 88 modes described above, as the inner sole 22 is urged toward the outer sole 20, upper member 100 is urged toward lower member 102 compressing springs 80 of each of the link rods 68.

As with each of the modes described herein, because of the guide rod 76 of the trailing member 72 being in the passageway 74 of the keeper 70, stability between the upper member 100 and lower member 102 is maintained as they are compressed together, in all 360° about a vertical axis in the direction of movement. Because of pins 32 and 96 in the first 26 and second 88 modes, the stability is maintained in only about 1800 about a vertical axis by the link rods 68 in the direction of movement.

Figure 13:
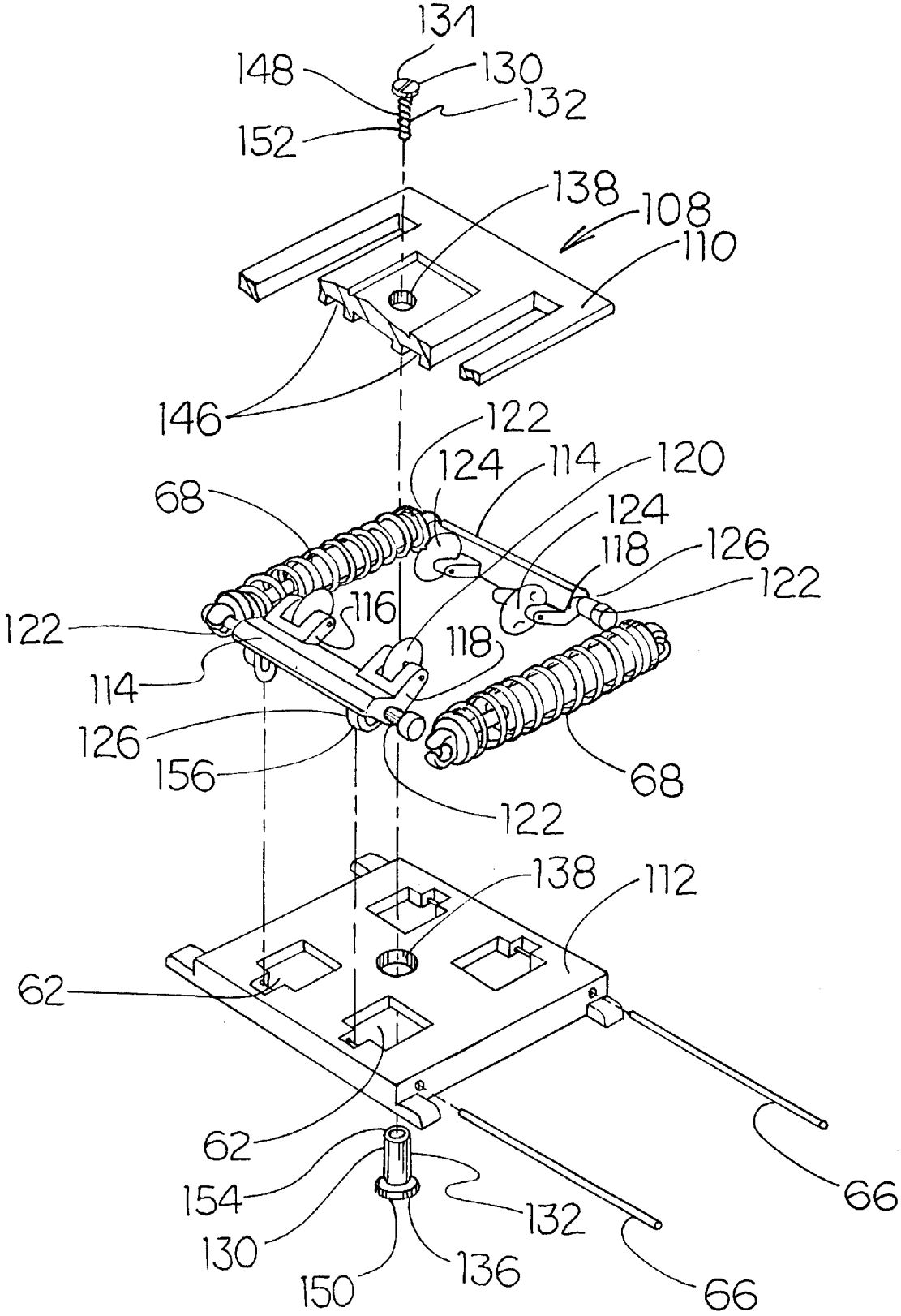
FIGS. 13, 14 and 15 are similar to FIG. 2 of a fourth mode of the invention in which the sliders are pivotally secured to the lower member or pedestal of the mode.
Figures 14, 15:
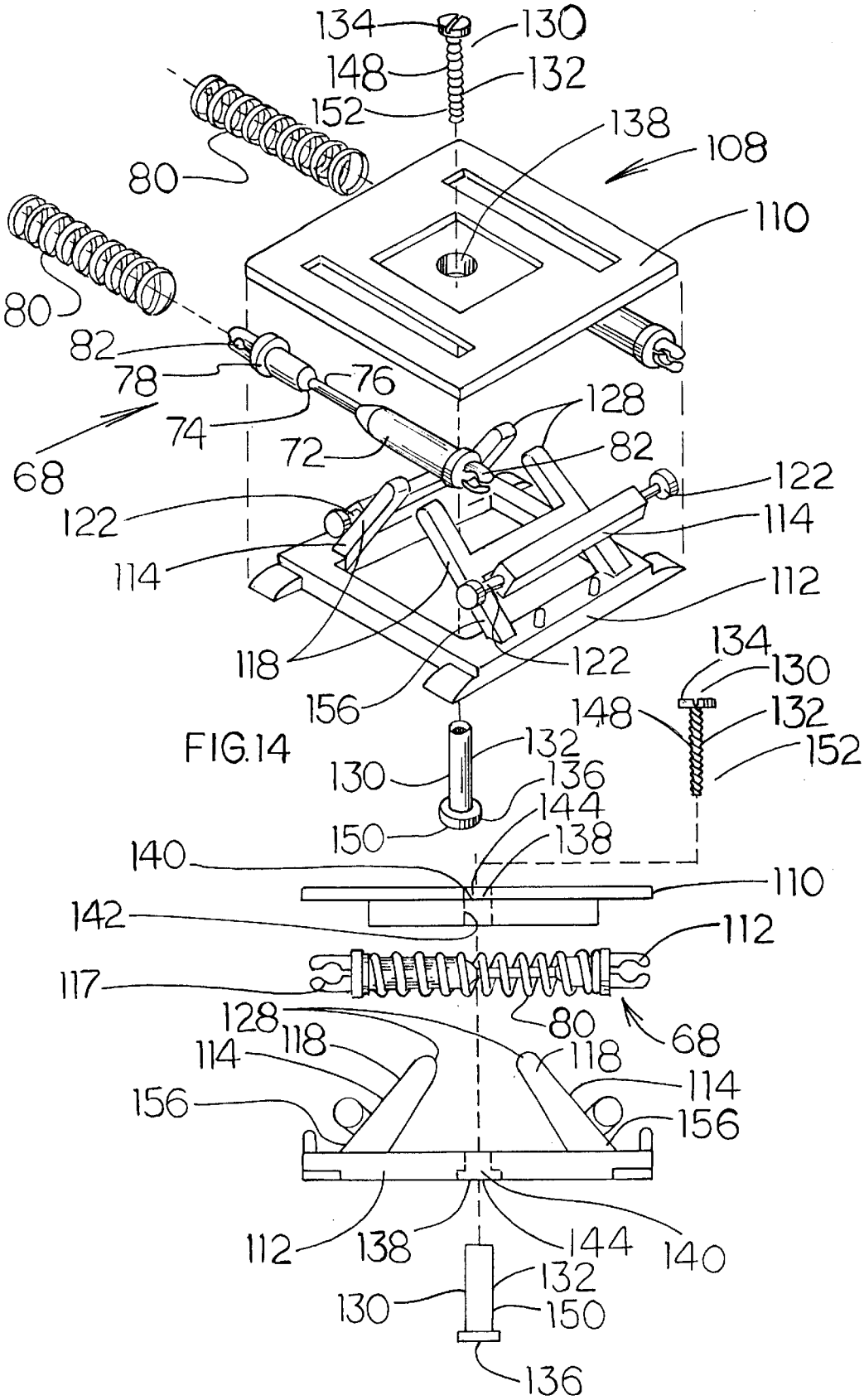

Referring to FIGS. 13, 14, 15, 16 and 17, there is shown a fourth mode 108 of the invention to include both an upper member or pedestal 110, a lower member or pedestal 112, a pair of sliders 114, and a pair of link rods 68. Sliders 114 are pivotally positioned within spaced apart link openings 62 in the bottom member 112 and are pivotally connected thereto by link pins 66. Sliders 114 have a lever portion 118 with, a slider portion 120 at one end 116 of the slider 114, and a lever portion 156 with a link rod connector 122 at the other end 126 of the slider 114. In the specific embodiment illustrated, slider portion 120 is shown to comprise a wheel 124, pivotally connected to the end 116 of the lever portion 118 opposite the connector 122. In other embodiments, a skid 128 is utilized instead of the wheel 124 as shown in FIGS. 14 and 15.

The entire assemblage of sliders 114 and link rods 68 are assembled together with sliders assembled on bottom member 112 and held sandwiched between bottom member 112 and top member 110 by pin 130 positioned in centrally located hole 138 in both members 110, 112. Hole 138 is step diametered having opposite flange countersunk ledges 140. A small diametered portion 142 of hole 138 extends between opposite facing ledges 140. Large portions 144 of hole 138 extend between upper 84 and lower 88 planar surface of member 110, 112, respectively, and ledges 140. Pin 130 has a shank portion 132 and opposite enlarged heads 134 and 136. Heads 134, 136 hold the top member 10 and bottom member 112 together. Sliders 114 are urged upwardly or as shown in FIGS. 13 and 14, and upper member 110 and lower member 112 are urged apart against the enlarged heads 134, 136 of pin 130 by the springs 80 of the two link rods 68 extending between pins 122 on opposite sides of pin 130.

The tolerances of hole 138, diametered portions 142 and 144 and shank portion 132 and heads 134 and 136 are loose to allow upper 110 and lower 112 members to move toward and away from each other in all 360° about the longitudinal axis of pin 130. Upper member 110 has a pair of spaced parallel grooves 146 therein in which wheels 124 or skids 128 are positioned. Grooves 146 and pins 16 maintain sliders 114 in position.

Pin 130, in the specific embodiment illustrated, comprises a male member 148 having a threaded shank 152 and a female member 150 having a threaded passageway 154. Pieces 148, 150 may be threaded together by inserting the threaded shank 152 into the threaded opening 154. Male member 148 has head 134 thereon, female member 150 has head 136 thereon. By means of pin pieces 148, 150, pin 130 may be lengthened or shortened as desired to move upper and lower members 110, 112 toward or away from each other and accordingly move sliders 114 relative to members 110, 112 and to compress or expand springs 80 of link rods 68 connected between sliders 114. In this manner, the stability and the shock absorbing properties of mode 108 be adjusted for the weight of the person who will be wearing the shoes in which mode 108 is positioned. By shortening pin 130 between the heads 134 and 136, springs 80 are compressed and the forces required to move members 110, 112 together are increased in accordance with Hooks law. Similarly, pin 130 may be lengthened and heads 134, 136 moved apart so as to allow members 110, 112 to move away from each other, and springs 80 are allowed to expand, and the force necessary to move member 110, 112 together against the urging of the springs 80 decreases.

In each of the other modes, i.e. modes 26, 88, and mode 98, different persons using the shoe are accommodated by providing springs 80 with different spring constants.

In operation, when the upper member 110 and the bottom member 112 are urged together under impact, the pin 130 is moved within the hole 138 to dislodge heads 134 and 136 from countersunk ledges 140, the sliders 114 are moved inwardly of the upper member 110 and the springs 80 of the link rods 68 are compressed. In the fully compressed position shown in FIG. 17, sliders 114 are positioned within link openings 62 of the bottom member 112. The slider wheels 124 are both within the grooves 146, and the link opening 62.

Figure 16:
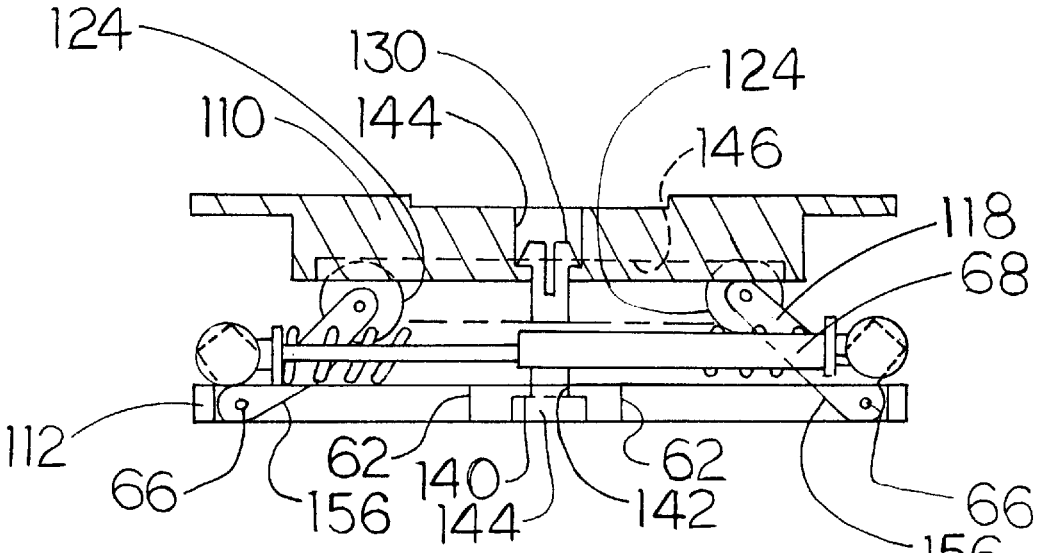
FIGS. 16 and 17 are similar to FIGS. 3 and 5 of the fourth mode of the invention illustrated in FIGS. 13, 14 and 15.
Figure 17:
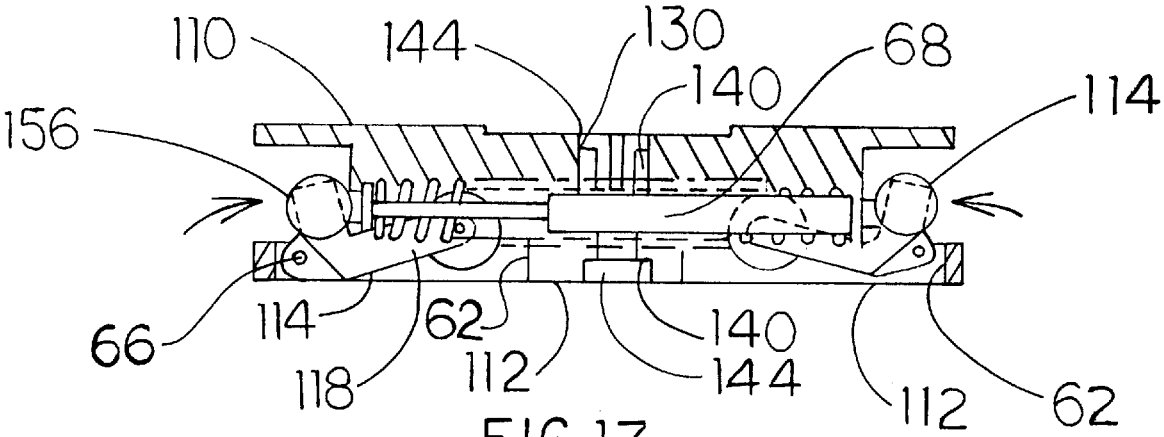
Figure 18:
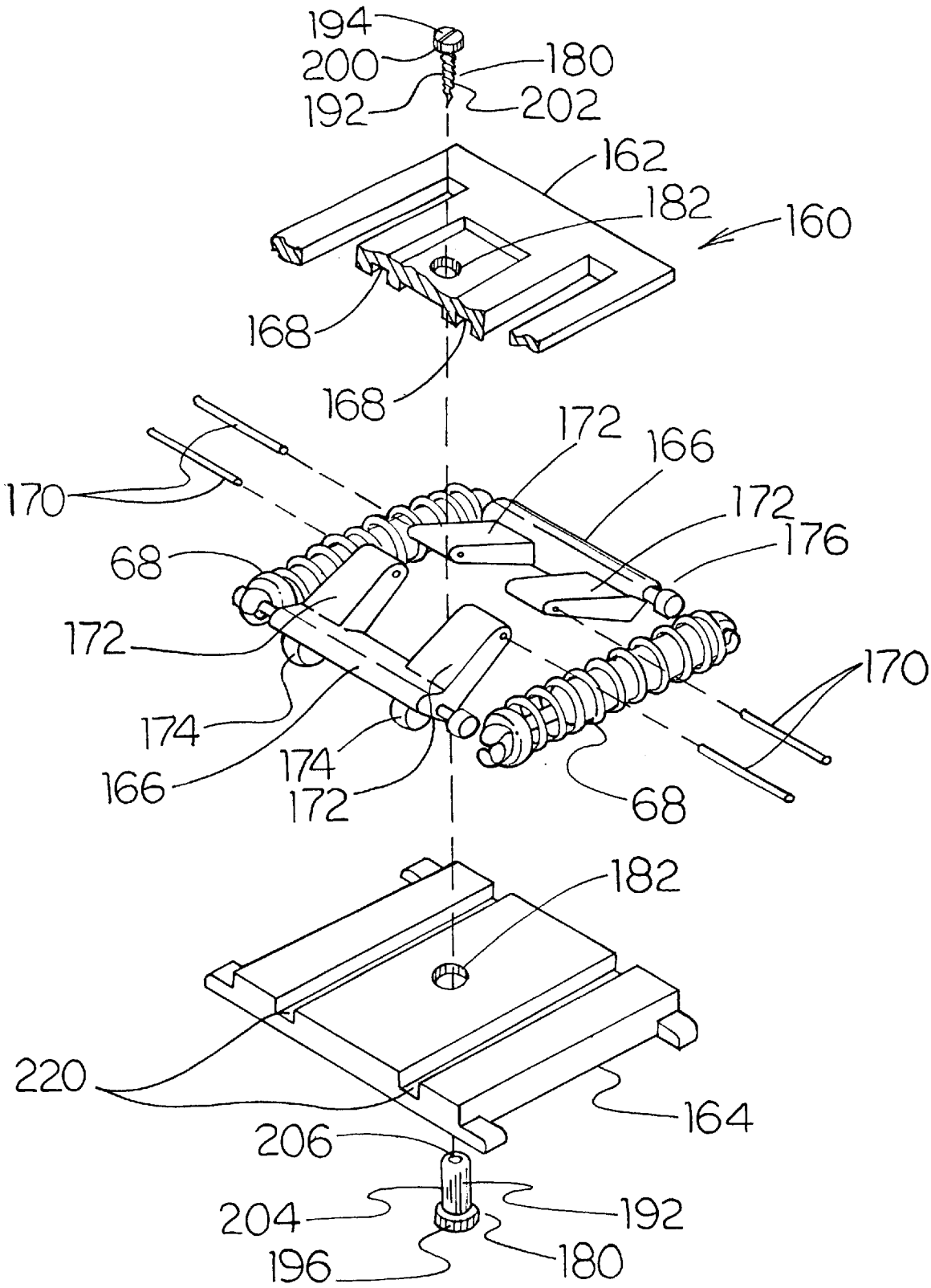
FIGS. 18, 19 and 20 are similar to FIG. 2 of a fifth mode of the invention in which the sliders are secured to the upper member or pedestal of the mode.
Figure 19:
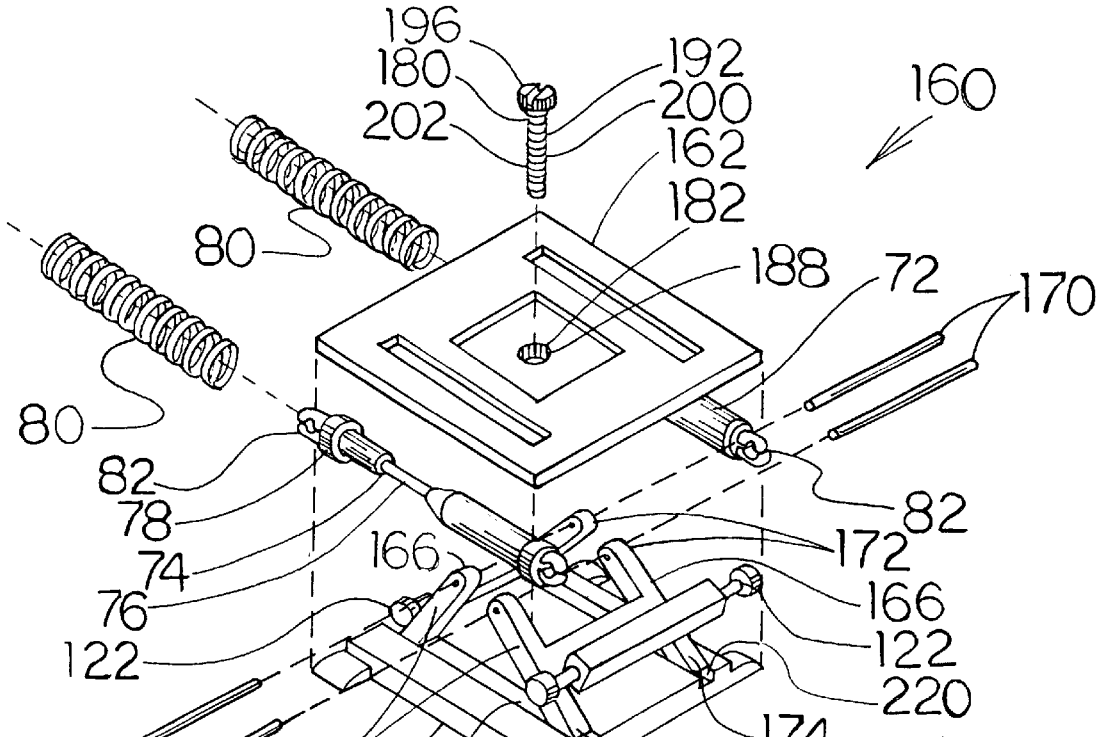

In the specific embodiments illustrated, each of the upper member 110, bottom member 112, sliders 114, wheels 124, pins 66 and 116, keeper 70 and trailer 72 of the link rods 68, connectors 124, 122 are all made of molded polymeric materials having the appropriate physical properties required. Pin 130 is positioned within a hole 138 in upper plate 110 and bottom plate 112. Hole 138 is countersunk forming ledges 140 against which heads 134, 136 are positioned in its expanded condition as illustrated in FIG. 16. Upper member 110 and bottom 112 define a upper support planar surface 84 and a lower support planar surface 86. In the specific embodiment illustrated, upper member 110 has grooves 142 therein in which slider wheels 134 travel. The positioning of pins 66 in relationship to the connector 122 and the axis of the slider wheel 124 are such that when the upper member 110 is urged toward the bottom member 112, springs 80 on the link rods 68 are compressed and the guide rod 76 is moved further into the passageway 74 of the keeper 70 of the link rods 68.

The fourth mode 108 of the new and improved shock absorption mechanism 10 of the invention has the advantage that the exterior dimensions other than the thickness of the fourth mode 108 never varies. The entire shock absorption compression by the springs 80 is accommodated within the outer dimensions of the upper 84 and lower 86 surfaces defined by upper 110 and lower 112 members. Furthermore, because of the larger size of the two link rods 68 in the Fourth mode 108 as compared to the multiple link rods of the first 26, second 88 and third 98 modes, a great amount of shock movement between upper member 110 and lower 112 members may be absorbed with a small amount of movement of the springs 80. Additionally, because of the looseness of the fitting between the pin 130 and the hole 138 in upper and lower member 110, 112 respectively, members 110 and 112 can move relative to each other to position upper support planar surface and lower support planar surface generally parallel or accommodate a non-parallel inner sole 22 and outer sole 20 as the case may be in all 360° about the vertical axis of pin 130.

Slider 114, lever portion 118, connector 122 and lever portion 156 are of different lengths, thus, the compressive force necessary to move upper pedestal 110 and lower pedestal 112 together is greater the compressive force exerted on link rods 68. The mechanical advantage provided by lever portions 118 and 156 together with springs 80 which function in accordance with Hooks law provide for upper pedestal 110 and lower pedestal 112 to function as a shock absorber and to reduce the acceleration of the application of forces and the velocity of the movement of pedestals 110, 112 together to zero proportionally in a gradual manner. Such shock absorption can be adjusted for the weight of the person utilizing the shock absorption mechanism 10 of the invention in the heel of the shoe by shortening or lengthening the length of pin 130 by means of the pin pieces 148, 150. In each of the other modes of the invention, mode 26 and mode 88, the weight of the person and the shock absorbing properties thereof are adjusted by equipping the devices with springs having different spring constants. Each of these devices, however absorb shock in accordance with Hooks law. Each of the devices of the invention absorb shock proportional to the force applied in contrast to the aforementioned portions and air bladders which absorb shock in accordance with the gas law in which the force applied is absorbed inversely proportionally to the pressure within the air bladder or air cushion. Shock absorption by an air cushion is felt by the wearer of the shoes to include a greater impact than with the mechanical devices of the invention. The mechanical devices of the invention are thus preferred, in that they result in a greater reduction of stress on the skeleton of the person utilizing the shock absorbing mechanism of the invention, result in less compression of the vertebrae of the spine upon impact, and allow for the device to be adjusted to the weight of the person using the shock absorbing mechanism 10 of the invention in their shoes.

Referring to FIGS. 18, 19, 20, 21 and 22, there is shown a fifth mode 160 of the invention to include both an upper member 162 and a lower member 164, a pair of sliders 166 and a pair of link rods 68. Sliders 166 are pivotally secured to upper member 162 within grooves 168 and are pivotally connected thereto by link pins 170. In a specific embodiment, two link pins 170 can be used instead of the four illustrated by extending their length so as to space both grooves 168. Sliders 166 have a lever portion 172, a slider portion 174 and a link rod connector portion 176. Slider portion 174 in specific embodiments, may comprise a wheel 124 as utilized in the forth mode 108 or a skid 128 as previously described.

Figure 20:
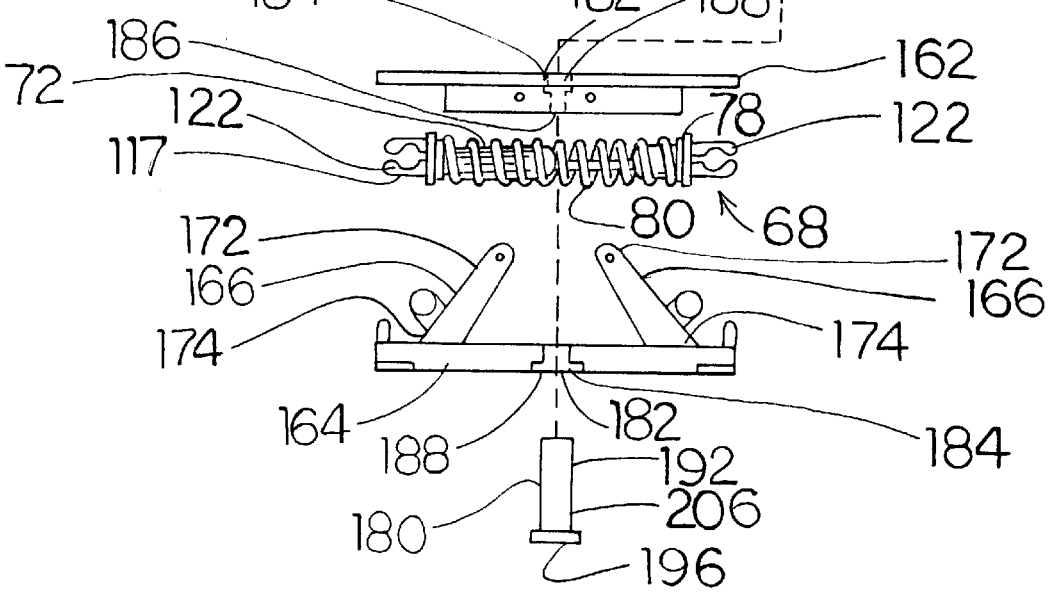
Figure 21:
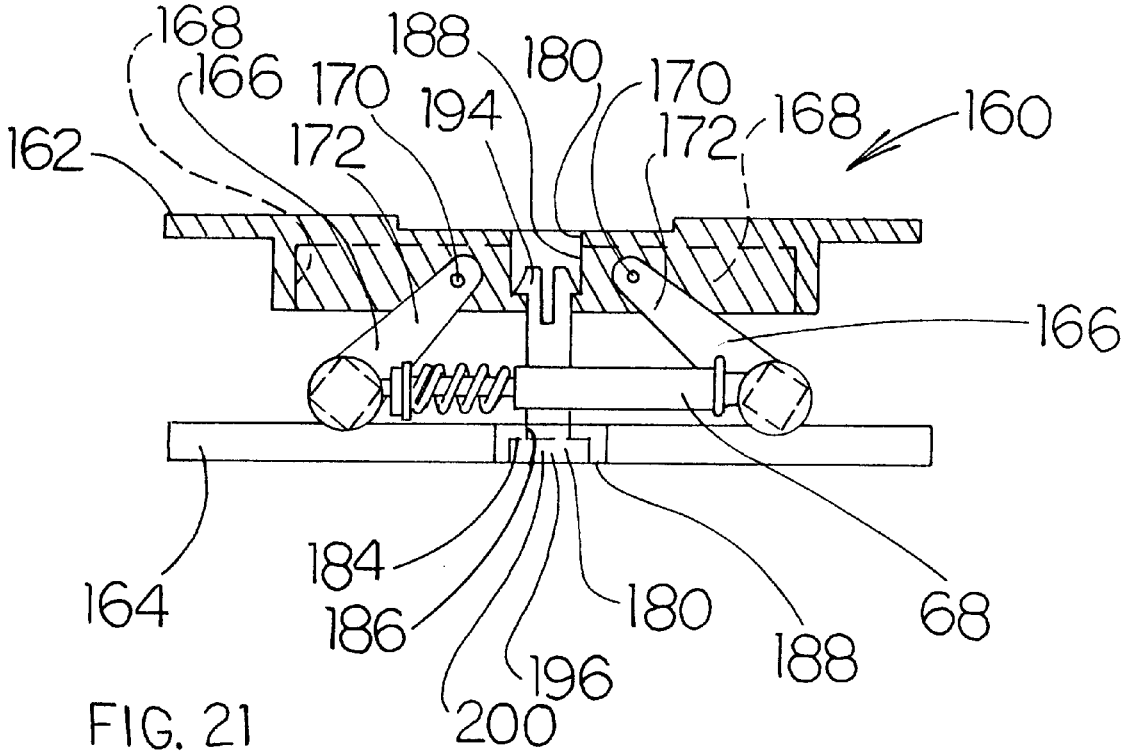
FIGS. 21 and 22 are similar to FIGS. 3 and 5 of the fifth mode of the invention illustrated in FIGS. 18, 19 and 20.
Figure 22:
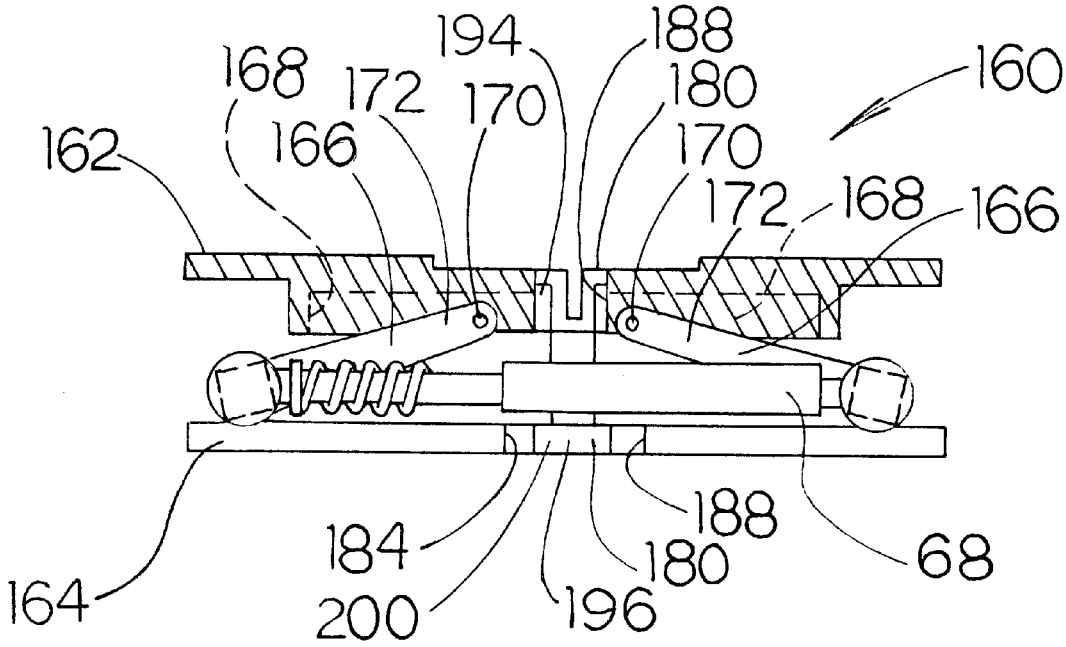

The entire assemblage of sliders 166 and link rods 68 is assembled on bottom member 164 and held sandwiched between bottom member 164 and top member 162 by a pin 180 positioned in a centrally located bore 182 in both top and bottom members 162, 164. Bore 182 is step diametered as shown in FIGS. 20–22 to form opposite facing flange countersunk ledges 184, a small diameter portion 186 extending between ledges 184, and large portions 188 of hole 182 extending between upper and lower planar surfaces 84, 86 of upper and lower members 162, 164, respectively, and ledges 184. Pin 180 has a shank portion 192 and opposite enlarged heads 194 and 196. Heads 194, 196 hold the top member 162 and bottom member 164 together.

Sliders 166 are urged apart against the enlarged heads 194, 196 of pin 180 by the springs 80 of the two link rods 68 extending between the sliders 166 on opposite sides of the pin 180. The tolerances of hole 182, diametered portions 186 and 188 and pin 80 and shank 192 and heads 194, 196 are loose to allow upper 162 and lower 164 members to move toward and away from each other in all 360° about the longitudinal axis of pin 180. Upper member 162 has a pair of spaced parallel grooves 168 therein in which the lever portions 172 of the sliders 166 are positioned and pivotally secured to upper member 162. Grooves 168 and pins 170 maintain sliders 66 in position. Pin 180 in a specific embodiment illustrated, comprises a male member 200 having a threaded shank 202 and a female member 204 having a threaded passageway 206. Male and female members 200 and 204 may be threaded together by inserting the threaded shank 202 into the threaded passageway 206. By means of male member 202 and female 204, pin 180 may be lengthened or shortened as desired to move upper and lower members 162, 164 toward or away from each other and accordingly move sliders 166 relative to member 162 to compress or expand springs 80 of link rods 68 connected between the sliders 166. In this manner, the stability and the shock absorbing property of mode 160 may be adjusted for the weight of the person who will be wearing the shoes in which the shock absorbing mechanism of the invention is installed. By shortening the pin 180 between the heads 194,196, springs 80 are expanded and the forces to required to move upper and lower members 162, 164 are increased in accordance with Hook's law. Similarly, pin 180 may be lengthened and the heads 194, 196 are moved apart so as to allow members 162, 164 to move away from each other and springs 80 are compressed, and the force necessary to move members 162, 164 together against the urgency of the springs 80 are decreased in accordance with Hook's law.

Only in modes 108 and 160 are shoes of different persons having different weights engaging in different activities accommodated by adjusting the pins 130, 180. In each of the other modes, i.e. modes 26, 88, and 98 different persons using the shoe and different shoe activities are accommodated by providing springs 80 with different springs constants.

Modes 108 and 160 are similar. The major difference between the two modes is where the sliders are pivoted. In mode 108, sliders 114 are pivoted to bottom member 112. In mode 160 the sliders are pivoted to top member 162. Sliders 114 slide against top member 110 in mode 108, whereas sliders 166 slide against bottom member 164 in mode 160. Additionally, link rods 68 are compressed in mode 108 as upper member and lower members 110, 112 are urged together under impact. In contrast, springs 80 of link rods 68 are expanded in mode 160 when upper member and lower members 162, 164 are urged together under impact. In a specific embodiment, grooves 220 may be formed in bottom 162 so as to guide sliders 166 in their movement across bottom 162 as link rods 68 are compressed and expanded during use. In all other respects, mode 160 is the same as herein above disclosed with regard to mode 108 in both structure and function.

In operation, when the upper member 162 and the bottom member 164 are urged together under impact, pin 180 is moved within the hole 182 to dislodge heads 194, 196 from the counter sunk ledges 184, the sliders 166 are moved outwardly of the lower member 164 in grooves 220 and the springs 80 of the link rods 68 are expanded. The fully compressed position is shown in FIG. 22.

In the specific embodiment illustrated, each of the upper member 162, bottom member 164, sliders 166, pins 170, keeper 70 and trailer 72 of the link rods 68, connectors 124, 122 are all made of molded polymeric material having the appropriate physical properties required. Pin 180 is positioned within hole 182 in upper plate 162 and bottom plate 164. Hole 182 is counter sunk forming ledges 184 against which heads 194, 196 are positioned in its expanded position as illustrated in FIG. 21. Upper member 162 and bottom member 164 define an upper support planar surface 84 and a lower support planar surface 86. In a specific embodiment illustrated, upper member 162 has grooves 168 therein in which sliders 166 are pivotally connected to upper member 162. Lower member 164 has grooves 220 therein in which the sliders move relative to lower member 164 as the link rods 68 are compressed or expanded. The positioning of the pins 170 in relationship to the connectors 122 are such that when the upper member 162 is urged toward the lower member 164, springs 80 and the link rod 68 are expanded and the guide rod 76 is moved out of the passageway 74 of the keeper 70 of the link rod 68. Fifth mode 160 of the new and improved shock absorption mechanism 10 of the invention has the advantage over modes 26, 88 and 98 that the exterior dimensions other than the thickness of the fifth mode 160 never varies. Similar to mode 108, the entire shock absorbing compression by the springs 80 is accommodated within the outer dimensions of upper 84 and lower 86 surfaces defined by upper member 162 and lower member 164. Furthermore, because of the larger size of the two link rods 68 as compared to the multiple link rods of the first 26, second 88 and third 98 modes, a greater amount of the shock may be absorbed with a small amount of movement of the springs 80. Additionally, because of the looseness of the fitting of the pin 180 in the hole 182 in upper and lower members 162, 164 respectively, members 162 and 164 can move relative to each other to position upper support planar surface and lower support planar surface generally parallel or accommodate non-parallel inner sole 22 and outer sole 20 as the case may be in all 360° about the vertical axis of pin 180. Similar to slider 114 in the forth mode 108, slider 166, lever portion 172, connector 174 all of different lengths, thus, the compressive force necessary to move upper member 162 and lower member 164 together is greater than the expansive force asserted on link rods 68. The mechanical advantage provided by lever portions 172 and 174 together with springs 80 which function in accordance with Hook's law provide for upper member 162 and lower member 164 to function as a shock absorber and to reduce the acceleration of the application of forces and the velocity of the movement of members 162, 164 together to 0 proportionally, in a gradual manner. Such shock absorption may be adjusted for the weight of the person utilizing the shock absorbing mechanism 10 of the invention in the heel of shoe by shortening or lengthening the pin 180 by means of the pin pieces 200 and 204.

Only in forth mode 108 can a similar adjustment be accommodated. In each of the other modes of the invention, the weight of the person and the shock absorbing properties of the mechanism 10 are adjusted by equipping the devices with springs having different spring constants. Each of these devices however absorb shock in accordance with Hook's law and out perform the prior art air bladders as above described.

The shock absorbing mechanism of the invention provides a new and improved shock absorbing mechanism for shoes which maintains its shock absorbing properties throughout the life of the shoe. The shock absorbing device is purely mechanical and does not have any of the disadvantages of air cushions and air bladders. The shock absorbing mechanism of the invention can be placed in the heel portion of the shoe and is dimensionally stable during compression, comprised of few parts, is relatively inexpensive to manufacture, and relatively simple to manufacture and assemble. The new and improved shock absorbing mechanism of the invention provides the shoe with adequate support and stability during use while absorbing shock under impact.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A shock absorbing mechanism for a shoe comprising a plurality of connected structural members, at least one of said structural members defining an upper support surface of an upper pedestal, at least another of said structural members defining a lower support surface of a lower pedestal, means including said plurality of connected structural members for spacing said upper and lower support surfaces apart and for allowing said upper and lower support surfaces to be movable toward and away from each other, said upper and lower support surfaces defining the exterior length, width and height dimensions of said mechanism, said means including a plurality of expandable and collapsible members being connected to said structural members between said upper and lower support surfaces within said length, width and height dimensions of said mechanism, said extendable and collapsible members being moveable between an extended position and a collapsed position without increasing said length and width dimensions of said mechanism as defined by said upper and lower support surfaces, means including each of said extendable and collapsible members for resisting the force applied to compress said upper and lower support surfaces together by a force less than the force applied between said upper and lower support surfaces, each of said extendable and collapsible members having a spring associated therewith urging said connected structural members into an at rest position, said spring both supporting the wearer of the shoe and cushioning all impacts on the wearer of the shoe by decreasing the velocity of all movement from said at rest position between said connected structural members in accordance with Hook's law, a pin and a pair of sliders, said pin extending between said one and another of said connected structural members, said upper and lower support surfaces being moveable toward and away from each other guided by said pin, said pin holding said one and another of said connected structural members together, said sliders being positioned between said upper and lower support surfaces, said extendable and collapsible members being pivotally connected to said sliders, said sliders and said extendable and collapsible members being movable from said at rest position when said upper and lower support surfaces move with respect to each other from said at rest position, said spring of each of said extendable and collapsible members urging said extendable and collapsible members into said at rest position.

2. The shock absorption mechanism of claim 1 wherein said extendable and collapsible members being pivotally connected to said members between said pedestals.

3. The shock absorption mechanism of claim 1 wherein said members are pivotally joined together to form a linkage, said members having opposite ends, one group of opposite ends defining said upper support surface, another group of opposite ends defining said lower support surface, said extendable and collapsible members being pivotally connected between said members.

4. The shock absorption mechanism of claim 1 wherein said members are linked together to form a linkage, said members being able to slide with respect to each other, further comprising a pedestal, one group of ends being pivotally connected to said pedestal, said pedestal defining one of said upper and lower support surfaces, said extendable and collapsible members being pivotally connected between said pedestal and said members.

5. The shock absorption mechanism of claim 1 wherein said extendable and collapsible members each include a male member having a rod, a female member having a cavity in which said rod is positioned and may slideably move axially of said rod, opposite and spaced apart collars on both said male and female members, a spring positioned between said collars, and bushings secured to said collars whereby said extendable and collapsible members are pivotally connected between said members.

6. The shock absorption mechanism of claim 1 wherein said members define an upper pedestal and a lower pedestal, and further comprising a pin connecting said upper pedestal to said lower pedestal, said upper and lower pedestals being moveable with respect to said pin and to each other from an expanded position toward each other in all directions, said extendable and collapsible members being positioned between said upper and lower pedestals, said extendable and collapsible members urging said upper and lower pedestals into said expanded position, said extendable and collapsible members decelerating all movement between said pedestals and supporting any load placed upon said pedestals.

7. The shock absorption mechanism of claim 6 wherein said pin is positioned in a bore in said upper pedestal and a bore in said lower pedestal, said bores both being step diametered having a small diametered portion extending from said upper and lower support planar support surfaces and a larger diametered portion adjacent said upper support and lower support planar surfaces, said smaller diametered portions and said upper diametered portions being separated by an outwardly facing lip, said pin having spaced apart enlarged ends which rest on lips of said upper pedestal bore and said lower pedestal bore when said upper pedestal and lower pedestal are in their said expanded position.

8. The shock absorbing mechanism of claim 1 wherein said extended position is a position in which said springs are in a collapsed position, said springs being expanded upon the movement of said upper support surface and said lower support surface together.

9. The shock absorbing mechanism of claim 1 wherein said extended position is a position in which said springs are in an extended position, said springs being compressed when said upper and said lower surfaces are moved toward each other.

10. The shock absorbing mechanism of claim 1 wherein said pin is adjustable in length so as to adjust said mechanism for the weight of the person utilizing said mechanism and the activity said person is engaging in while utilizing the mechanism.

11. A shock absorbing mechanism for a shoe comprising a plurality of connected structural members defining an upper pedestal and a lower pedestal, said upper pedestal having an upper support surface, said lower pedestal having a lower support surface, means including said plurality of connected structural members for spacing said upper and lower support surfaces apart and for allowing said upper and lower support surfaces to be movable toward and away from each other, said upper and lower support surfaces defining the exterior length, width and height dimensions of said mechanism, said means including a plurality of expandable and collapsible members being connected to said structural members between said upper and lower support surfaces within said length, width and height dimensions of said mechanism, said extendable and collapsible members being movable between an extended position and a collapsed position without increasing said length and width dimensions of said mechanism as defined by said upper and lower support surfaces, means including each of said extendable and collapsible members for resisting the force applied to compress said upper and lower support surfaces together by a force less than the force applied between said upper and lower support surfaces, each of said extendable and collapsible members having a spring associated therewith urging said connected structural members into an at rest position, said spring supporting the wearer of the shoe and cushioning all impacts between said wearer of the shoe and said shoe by decreasing the velocity of all movements from said at rest position between said connected structural members in accordance with Hook's Law a pin connecting said upper pedestal to said lower pedestal, said upper and lower pedestals being movable with respect to said pin and to each other from an expanded position toward each other in all directions, said extendable and collapsible members being positioned between said upper and lower pedestals, said extendable and collapsible members urging said upper and lower pedestals into said expanded position, said extendable and collapsible members decelerating all movement between said pedestals and supporting any load placed upon said pedestals, at least one lever arm pivotally connected to one of said upper and lower pedestals adjacent one end thereof, said lever arm having ends on opposite sides of its pivotal connection to said pedestal, one of said opposite ends engaging the other of said upper and lower pedestals and being movable thereon when said pedestals are moved toward and away from each other, said extendable collapsible members being connected to the other of said opposite ends of said lever arm whereby the force urging said pedestals together is transmitted to said extendable and collapsible members through said lever arm and said extendable and collapsible members urge said pedestals apart through said lever arm.

12. A shock absorbing mechanism for a shoe comprising a plurality of connected structural members defining an upper pedestal and a lower pedestal, said upper pedestal having an upper support surface, said lower pedestal having a lower support surface, means including said plurality of connected structural members for spacing said upper and lower support surfaces apart and for allowing said upper and lower support surfaces to be movable toward and away from each other, said upper and lower support surfaces defining the exterior length, width and height dimensions of said mechanism, said means including a plurality of expandable and collapsible members being connected to said structural members between said upper and lower support surfaces within said length, width and height dimensions of said mechanism, said extendable and collapsible members being moveable between an extended position and a collapsed position without increasing said length and width dimensions of said mechanism as defined by said upper and lower support surfaces, means including each of said extendable and collapsible members for resisting the force applied to compress said upper and lower support surfaces together by a force less than the force applied between said upper and lower support surfaces, each of said extendable and collapsible members having a spring associated therewith urging said connected structural members into an at rest position, said supporting the wearer of the shoe and cushioning all impacts between said wearer of the shoe and the shoe by decreasing the velocity of all movement from said at rest position between said members in accordance with Hook's law, a pin connecting said upper pedestal to said lower pedestal, said upper and lower pedestals being moveable with respect to said pin and to each other from an expanded position toward each other in all directions, said extendable and collapsible members being positioned between said upper and lower pedestals, said extendable and collapsible members urging said upper and lower pedestals into said expanded position, said extendable and collapsible members decelerating all movement between said pedestals and supporting any load placed upon said pedestals, a plurality of lever arms pivotally connected to one of said upper and lower pedestals adjacent one end thereof, said lever arm having ends on opposite sides of its pivotal connection to said one pedestal, one of said opposite ends engaging the other of said upper and lower pedestals and being movable thereon when said pedestals are moved toward and away from each other, said extendable and collapsible members being connected between the other of said opposite ends of said lever arms whereby the force urging said pedestals together is transmitted to said extendable and collapsible members through said lever arms and said extendable and collapsible members urge said pedestals apart through said lever arms.

13. The shock absorption mechanism of claim 12 wherein said extendable and collapsible members each include a male member having a rod, a female member having a cavity in which said rod is positioned and may slideably move axially of said rod, spaced opposite collars on both said male and female members, a spring positioned between said collars, and bushings secured to said collars respectively whereby said extendable and collapsible members are pivotally connected between said lever arms.

14. The shock absorbing mechanism of claim 13 wherein the compression of said resilient members upon urging said pedestals together being less than the movement of said pedestal.

15. The shock absorption mechanism of claim 13 wherein said means reduces the size of said extendable and collapsible members upon the urging of said pedestals together, said extendable and collapsible members being reduced in size less than the movement of said pedestals.

16. The shock absorbing mechanism of claim 13 wherein said means expands said extendable and collapsible members upon the urging of said pedestals together, said extendable and collapsible members expand less than the movement of said pedestals.

17. The shock absorbing mechanism of claim 16 wherein the force necessary to urge said pedestals together being greater than the force necessary to expand said extendable and collapsible members upon a movement of said pedestals together.

18. The shock absorption mechanism of claim 15 wherein the force necessary to urge said pedestals together being greater than the force necessary to reduce the size of said extendable and collapsible members upon the movement of said pedestals together.

19. The shock absorbing mechanism of claim 18 wherein the force necessary to urge said pedestals together being greater than the force necessary to compress said resilient members upon a movement of said pedestals together.

20. The shock absorbing mechanism of claim 12 wherein said extendable and. collapsible members each include a male member having a rod, a female member having a cavity in which said rod is positioned and may slideably move axially of said rod, spaced opposite collars on both male and female members, a spring positioned between said collars, and bushings secured to said collars whereby said extendable and collapsible members are pivotally connected between said lever arms.

21. A shock absorbing mechanism for insertion into a hollow cavity within the heal of a shoe, said heal cavity having an upper support surface and a lower support surface between which said mechanism is positioned, said mechanism comprising a plurality of resiliently extendable and collapsible members pivotally connected between a plurality of structural members which support said upper and lower surfaces in a spaced apart extended position, said upper and lower support surfaces in said spaced apart extended position thereof defining the length, width and height dimensions of said mechanism in an at rest position, said structural members being pivotally rotated in relation to said resiliently extendable and collapsible members from said spaced apart extended position to a collapsed position between said upper and lower support surfaces, said extendable and collapsible members being movable between said extended and collapsed positions without extending beyond said length, width and height dimensions of said cavity, said extendable and collapsible members resisting the force applied to compress said upper and lower support surfaces together by a force less than the force applied between said upper and lower support surfaces, each of said extendable and collapsible members having at least one spring associated therewith, said spring urging said support surfaces and said structural members into said extended position, said spring urging said support surfaces of said cavity into said extended position and decreasing the velocity of all movement of said support surfaces from said extended position while being worn in accordance with Hook's Law, a pin and a pair of sliders, said pin extending between said plurality of structural members, said structural members being movable toward and away from other guided by said pin, said pin holding said structural members together, said sliders being positioned between said structural members, said extendable and collapsible members being pivotally connected between said sliders, said sliders and said extendable and collapsible members being moveable from said at rest position when said structural members move with respect to each other, said spring of each of said extendable and collapsible members urging said extendable and collapsible members into said at rest position corresponding to said at rest position of said structural members in accordance with Hook's Law.

* * * * *